US007000856B2

(12) United States Patent
Mattes et al.

(10) Patent No.: US 7,000,856 B2
(45) Date of Patent: Feb. 21, 2006

(54) VALVE WITH RADIAL RECESSES

(75) Inventors: Patrick Mattes, Stuttgart (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 156 days.

(21) Appl. No.: 10/332,379

(22) PCT Filed: Mar. 23, 2002

(86) PCT No.: PCT/DE02/01081

§ 371 (c)(1),
(2), (4) Date: Sep. 29, 2003

(87) PCT Pub. No.: WO02/090761

PCT Pub. Date: Nov. 14, 2002

(65) Prior Publication Data

US 2004/0056118 A1 Mar. 25, 2004

(30) Foreign Application Priority Data

May 10, 2001 (DE) ..... 101 22 503

(51) Int. Cl.
*F02M 61/00* (2006.01)

(52) U.S. Cl. ..... 239/533.12; 239/533.3; 239/584; 239/533.2; 123/467

(58) Field of Classification Search ..... 239/533.13, 239/533.3, 533.4, 584; 123/467
See application file for complete search history.

(56) References Cited

U.S. PATENT DOCUMENTS

| | | | | | |
|---|---|---|---|---|---|
| 1,952,816 | A | * | 3/1934 | Mock | 239/488 |
| 2,927,737 | A | * | 3/1960 | Zeuch et al. | 239/533.3 |
| 3,836,080 | A | * | 9/1974 | Butterfield et al. | 239/96 |
| 4,153,205 | A | * | 5/1979 | Parrish, Jr. | 239/533.9 |
| 4,523,719 | A | * | 6/1985 | Hofmann | 239/533.12 |
| 5,743,470 | A | * | 4/1998 | Schlaf et al. | 239/533.4 |

FOREIGN PATENT DOCUMENTS

| | | | |
|---|---|---|---|
| DE | 195 47 423 A1 | | 6/1997 |
| DE | 19820513 | * | 5/1998 |
| DE | 19844638 | * | 9/1998 |
| DE | 19931891 | * | 7/1999 |
| EP | 0 283 154 A1 | | 9/1988 |
| EP | WO 02 01066 | * | 6/2001 |
| GB | 562033 | * | 6/1944 |

* cited by examiner

*Primary Examiner*—Dinh Q. Nguyen
(74) *Attorney, Agent, or Firm*—Ronald E. Greigg

(57) ABSTRACT

A valve having a valve needle axially displaceable in a bore of a valve body and which has a conical valve needle tip having a radial valve sealing face, which in the closing position comes to rest on a conical inner wall of the valve body on the closed end of the bore. In the inner wall of the valve body there is at least one opening which connects the bore with the outside of the valve body. The valve includes two radial recesses disposed in the valve needle tip or in the inner wall of the valve body, and one of the radial recesses is located upstream and the other radial recess is located downstream from the position of the valve sealing face, in the closing position of the valve.

20 Claims, 1 Drawing Sheet

VALVE WITH RADIAL RECESSES

CROSS-REFERENCE TO RELATED APPLICATIONS

This application is a 35 USC 371 application of PCT/DE 02/01081 filed on Mar. 23, 2002.

BACKGROUND OF THE INVENTION

1. Field of the Invention

Injection nozzles are essential components of self-igniting internal combustion engines. Among their tasks are metered injection, fuel preparation, shaping of the course of injection, and sealing off from the combustion chamber. In common rail Diesel injection systems, along with the main injection a preinjection is effected, which makes it possible to reduce exhaust emissions and noise. The present invention, however, relates not only to fuel injection nozzles but also to all types of nozzles and metering valves.

2. Prior Art

German Patent Disclosure DE 196 34 933 relates to a fuel injection valve for internal combustion engines, with a valve member that is axially displaceable in a bore of a valve body. On its end toward the combustion chamber of the engine, the valve member has a conical valve sealing face, with which it cooperates with a conical valve seat face on the closed end, toward the combustion chamber, of the bore of the valve body. The conical valve sealing face of the valve member is divided into two regions of different cone angles. At the transition between the two regions, a valve sealing edge is formed. The fuel injection valve also has at least one injection opening, which is located in the region adjoining the sealing edge downstream thereof. Finally, between the valve sealing face regions that each have a different cone angle, a shoulder is provided, which has advantages in terms of the accuracy of metering the injection quantity.

The metering of the injection quantity by a fuel injection nozzle varies over its service life, because of wear. Especially in common rail injectors, the position of the valve sealing face, that is, the face with which the valve needle tip comes to rest on the conical inner wall of the valve body, in the closing position of the valve. Because of wear, the valve sealing face can "wander" toward either a larger or a smaller diameter of the conical valve needle tip. Consequently in the closing position of the valve, the valve needle comes to rest at a higher point on the inner wall of the valve body, relative to the valve body. The result is an altered injection course. Particularly in common rail injection nozzles, this means that with an increasing number of load changes (number of alternating load stresses), the preinjection quantity becomes smaller and finally vanishes entirely.

SUMMARY OF THE INVENTION

One advantage of the present invention is that the "wandering" of the valve sealing face is limited, and the wear of the valve is reduced. This is attained by means of a valve having a valve needle which is axially displaceable in a bore of a valve body and which on one end has a conical valve needle tip. The valve needle tip includes a radial valve sealing face, which in the closing position of the valve comes to rest on a conical inner wall of the valve body on the closed end of the bore. In the inner wall of the valve body there is at least one opening, which connects the bore with the outside of the valve body. The valve includes two radial recesses, which are disposed in the valve needle tip or in the inner wall of the valve body, and one of the radial recesses is located upstream and the other radial recess is located downstream from the position of the valve sealing face, in the closing position of the valve.

Between the radial recesses there is a seat region, to which the "wandering" of the valve sealing face is limited. In the closing position of the valve, the valve needle tip comes to rest with the valve sealing face in this seat region on the conical inner wall of the valve body and thus seals off the bore upstream of the valve sealing face from the bore downstream of the valve sealing face and thus also from the outside of the valve body. In this connection, the outside of the valve body means the volume into which a flowing liquid or gaseous medium enters when, with the valve open, it emerges from the valve via the valve openings. As wear increases, the valve sealing face can "wander" (with respect to the closing position of the valve) either as far as the upper edge of the first recess downstream or as far as the lower edge of the second recess upstream, but no farther. The recesses prevent the valve needle tip from resting on the inner wall of the valve body at the place where the recesses are made radially in the valve needle tip or the inner wall of the valve body, because the recesses create a spacing between these two components of the valve.

In a preferred embodiment of the present invention, the conical valve needle tip has a jacket face which includes at least two regions with different cone angles.

The disposition of the at least two regions of the valve needle tip having the different cone angles, in combination with the positions of the two radial recesses of the invention and with the cone angle of the conical inner wall of the valve body, define the position of the valve needle tip at which the valve sealing face is located.

The present invention also relates to a method for producing the valve of the invention, in which the recesses are produced by machining a standard valve, for instance by metal-cutting machining. Using standard valves that are used in great quantities means that the valves according to the invention can be produced economically and with little effort.

BRIEF DESCRIPTION OF THE DRAWING

The invention will be described in further detail below in conjunction with the drawing, in which.

DESCRIPTION OF THE PREFERRED EMBODIMENTS

Figure 1:
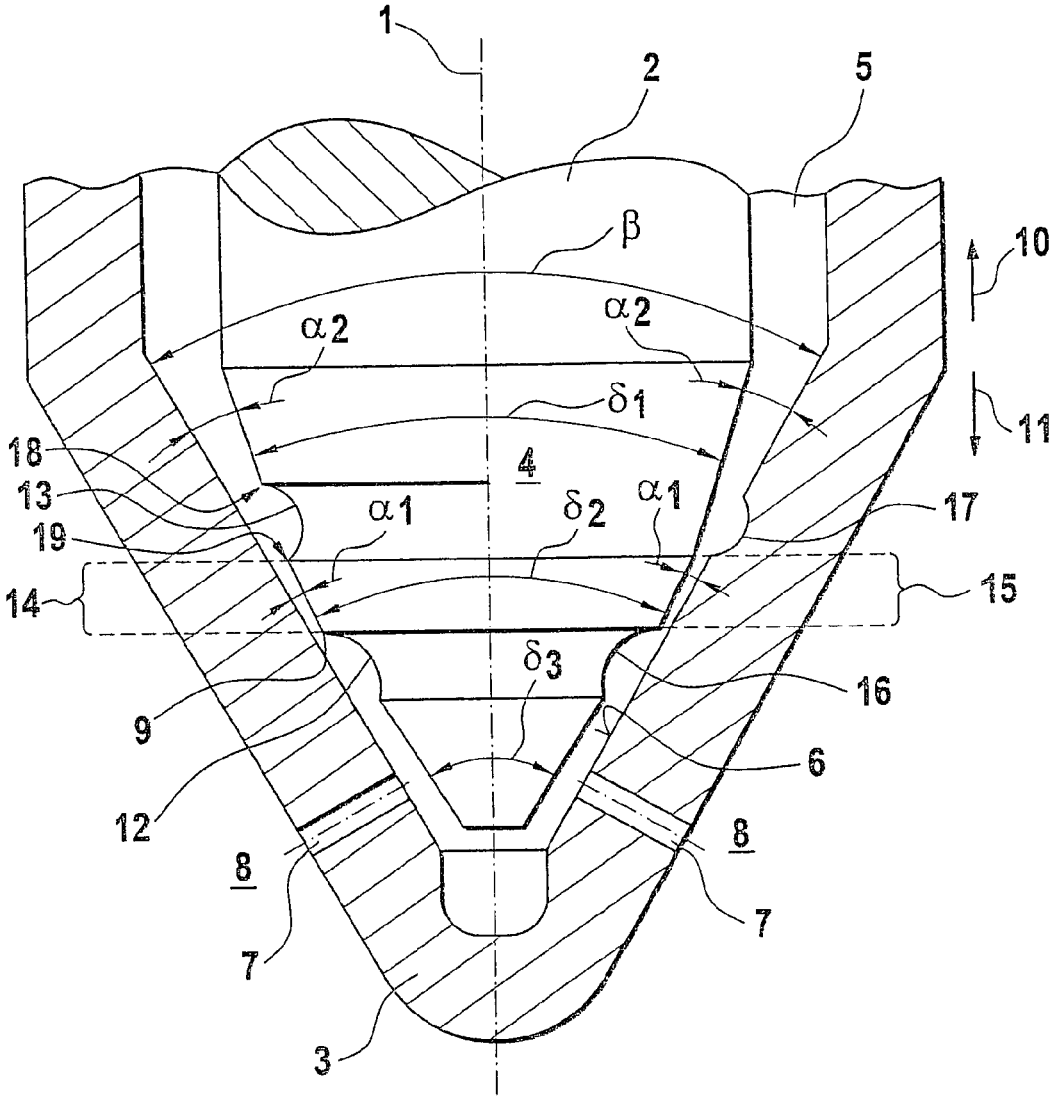
FIG. 1, shows two possible embodiments of the valve of the invention.

FIG. 1 shows two variants of the valve of the invention, combined in a single schematic drawing. One variant is shown on the left of the axis of symmetry 1, and the other is shown on the right. The main components of the valve shown are the valve needle 2 and the valve body 3; the valve needle 2 is axially displaceable in the valve body 3. The valve needle 2 has a conical valve needle tip 4 on its end. The valve body 3 includes a bore 5, which tapers conically on its end. Openings 7 are disposed in the conical inner wall 6 of the valve body and, when the valve is open, connect the bore 5 with the outside 8 of the valve body 3.

In the closing position of the valve, the valve needle tip 4 comes to rest, with a radial valve sealing face 9, on the conical inner wall 6 of the valve body. The valve sealing face 9 takes the form of the jacket face of a truncated cone. When the valve is closed, it rests on the conical inner wall 6 of the valve body and thus seals off the bore 5 upstream 10 of the valve sealing face 9 from the bore 5 downstream 11 of the valve sealing face 9. The valve is then tightly closed, and a liquid or gaseous medium cannot escape from the openings 7 to the outside 8.

In the first variant of the valve of the invention, shown on the left of the axis of symmetry 1, the valve includes two radial recesses 12 and 13. Both of them are disposed in the valve needle tip 4.

In this preferred embodiment of the valve of the invention, the jacket face of the valve needle tip 4 includes three regions with different cone angles $\delta_1$, $\delta_2$ and $\delta_3$. The three regions are each separated from one another by one of the two recesses 12, 13. The boundaries of the regions are located between the upper edge 18 and the lower edge 19, or on one of the two edges of the respective recess 12, 13. The cone angles $\delta_1$, $\delta_2$, $\delta_3$ of the three regions become larger upstream 11 ($\delta_1<\delta_2<\delta_3$). The cone angle $\beta$ of the conical inner wall 6 of the valve body is smaller than the cone angle $\delta_3$ and larger than the cone angle $\delta_2$. As a result, the position of the valve sealing face 9 of the valve, before it undergoes any wear, is precisely defined. It is located at the transition between the two regions having the cone angles $\delta_2$ and $\delta_3$, or, if as in FIG. 1 a recess 12 is disposed there, then at the upper edge of this recess 12. From wear, the contact position of the valve sealing face 9 at the inner wall 6 of the valve body in the closing position of the valve can shift only within the seat region 14 between the recesses 12 and 13. The spacing between the two recesses 12 and 13 predetermines how far the valve sealing face can "wander" at maximum, and accordingly predetermines how large the possible seat region 14 is.

By specifying $\delta_1<\delta_2$ for the cone angles of the two valve needle tip regions, two differential angles $\alpha_1$, $\alpha_2$ for the valve needle tip 4 relative to the conical inner wall 6 of the valve body result, for which the following relationship applies: $\alpha_2>\alpha_1$. This is a further provision for preventing wandering of the valve sealing face 9 toward a larger valve needle diameter, above the second recess 13. As a result, the valve sealing face 9, when the valve is closed, rests solely in the seat region 14 on the inner wall 6 of the valve body.

To assure that the differential angle $\alpha_2$ is greater than the differential angle $\alpha_1$, it would also be conceivable for the valve needle tip to have only two regions of different cone angles $\delta_2$ and $\delta_3$, but for the inner wall 6 of the valve body, in the closing position of the valve, upstream 10 of the lower edge of the second recess 13 to have a cone angle that is greater than the cone angle $\beta$ of the inner wall 6 of the valve body downstream 11 of it. Consequently, the conical end of the valve body 3 upstream 10 would have an "outward kink".

For the second variant, shown on the right of the axis of symmetry 1, of the valve of the invention, the same is true as for the first variant. The sole difference from the first variant is that only the first radial recess 16 is disposed in the valve needle tip 4, while conversely the second radial recess 17 is located in the inner wall 6 of the valve body. As a result, the same effect as in the first variant is attained: The valve sealing face 9 can "wander" because of wear only along the seat region 15, which in the closing position of the valve is defined by the two recesses 16 and 17.

Other variants of the valve of the invention (not shown in the drawing) are conceivable in which for example both recesses are disposed in the conical inner wall 6 of the valve body, or the first recess is disposed in the inner wall 6 of the valve body and the second recess is disposed in the valve needle tip 4.

In the variants of the present invention shown in FIG. 1, the recesses have a cross section with the shape of a circular segment (groove). Other possible shapes that the cross section of the particular recess can have are that of a circular sector, a triangle, quadrilateral or other polygon, or combinations of various ones of the shapes named. A combination is understood to include for instance a cross section with the shape of a sector of a circle that changes over into a quadrilateral.

In a preferred embodiment of the present invention, the valve is a fuel injection nozzle, preferably in self-igniting internal combustion engines. In fuel injection systems, over the service life of the fuel injection nozzle, there is a drift in the injection quantity from wear-dictated "wandering" of the valve sealing face 9. An altered course of injection can lead to unwanted exhaust emissions, louder running noise, or greater wear of the self-igniting engine. In a valve of the invention, this drift in the injection quantity is advantageously limited and sharply reduced, since the valve sealing face 9 can "wander" only within the seat region 14, 15. The maximum quantitative drift over the service life of the fuel injection nozzle can be established as a function of the axial spacing of the two recesses.

The valve of the invention is preferably used as a fuel injection nozzle in self-igniting internal combustion engines with common rail Diesel injection. Particularly in common rail nozzles, the preinjection quantity decreases as a result of wear-caused wandering of the valve sealing face 9 toward larger valve needle diameters, and in an extreme case, the preinjection is entirely absent. This is advantageously prevented by the use of valves according to the invention.

The valve of the invention can be embodied as a seat hole nozzle or as a blind bore nozzle. The openings 7 in a blind bore nozzle are disposed in a blind bore that, in the closing position of the valve, is located below the valve needle tip 4 in the valve body 3. In the case of seat hole nozzles, the beginning of the openings 7 is located in the inner wall 6 of the valve body in such a way that when the nozzle is closed, these openings are largely covered by the valve needle tip 4. In FIG. 1, a version of the valve of the invention in the form of a seat hole nozzle is shown.

The foregoing relates to preferred exemplary embodiments of the invention, it being understood that other variants and embodiments thereof are possible within the spirit and scope of the invention, the latter being defined by the appended claims.

What is claimed is:

1. In a valve including a valve needle (2) which is axially displaceable in a bore (5) of a valve body (3) and which on one end has a conical valve needle tip (4), the valve needle tip (4) including a radial valve sealing face (9), which in the closing position of the valve comes to rest on a conical inner wall (6) of the valve body on the closed end of the bore (5), at least one opening (7) in the inner wall (6) of the valve body, which opening connects the bore (5) with the outside (8) of the valve body (3), the improvement wherein the valve comprises two radial recesses (12, 13, 16, 17), which are disposed in the valve needle tip (4) or in the inner wall (6) of the valve body, and one of the radial recesses (13, 17) is located upstream (10) and the other radial recess (12, 16) is located downstream (11) from the position of the valve sealing face (9), in the closing position of the valve.

2. The valve of claim 1, wherein the conical valve needle tip (4) comprises a jacket face which includes at least two regions with different cone angles.

3. The valve of claim 1, wherein the conical inner wall (6) of the valve body comprises at least two regions with different cone angles, and the cone angles become larger upstream (10).

4. The valve of claim 1, wherein both radial recesses are disposed in the valve needle tip (4) or in the inner wall (6) of the valve body, or wherein one radial recess (16, 17) is disposed in the valve needle tip (4) and one radial recess is disposed in the inner wall (6) of the valve body.

5. The valve of claim 1, wherein the recesses (12, 13, 16, 17) have a cross section that has the shape of a circular segment (groove), a circular sector, a triangle, quadrilateral, or other polygon, or combinations thereof.

6. The valve of claim 1, wherein the valve is a fuel injection nozzle, preferably in self-igniting internal combustion engines.

7. The valve of claim 6, characterized in that the self-igniting internal combustion engines include a common rail Diesel injection system.

8. The valve of claim 1, wherein the valve is embodied as a seat hole nozzle or as a blind bore nozzle.

9. A method for producing a valve defined in claim 1, the method comprising forming the recesses (12, 13, 16, 17) are produced by machining a standard valve.

10. In a valve including a valve needle (2) which is axially displaceable in a bore (5) of a valve body (3) and which on one end has a conical valve needle tip (4), the valve needle tip (4) including a radial valve sealing face (9), which in the closing position of the valve comes to rest on a conical inner wall (6) of the valve body on the closed end of the bore (5), at least one opening (7) in the inner wall (6) of the valve body, which opening connects the bore (5) with the outside (8) of the valve body (3), the improvement wherein the valve comprises two radial recesses (12, 13, 16, 17), which are disposed in the valve needle tip (4) or in the inner wall (6) of the valve body, and one of the radial recesses (13, 17) is located upstream (10) and the other radial recess (12, 16) is located downstream (11) from the position of the valve sealing face (9), in the closing position of the valve, wherein the conical valve needle tip (4) comprises a jacket face which includes at least two regions with different cone angles, and wherein the jacket face of the valve needle tip (4) comprises three regions with different cone angles ($\delta_1$, $\delta_2$, $\delta_3$), and wherein the three regions, in the closing position of the valve, are each separated from one another by one of the two radial recesses (12, 13, 16, 17), and the cone angles ($\delta_1$, $\delta_2$, $\delta_3$) of the three regions become larger downstream (11).

11. In a valve including a valve needle (2) which is axially displaceable in a bore (5) of a valve body (3) and which on one end has a conical valve needle tip (4), the valve needle tip (4) including a radial valve sealing face (9), which in the closing position of the valve comes to rest on a conical inner wall (6) of the valve body on the closed end of the bore (5), at least one opening (7) in the inner wall (6) of the valve body, which opening connects the bore (5) with the outside (8) of the valve body (3), the improvement wherein the valve comprises two radial recesses (12, 13, 16, 17), which are each disposed within a respective surface in the valve needle tip (4) or in the inner wall (6) of the valve body, and each recess providing an indentation from its respective surface which is spaced away from an opposing surface of either the inner wall of the valve body or the valve needle tip by a distance which is greater than any other portion of its respective surface, wherein one of the radial recesses (13, 17) is located upstream (10) and the other radial recess (12, 16) is located downstream (11) from the position of the valve sealing face (9), in the closing position of the valve.

12. The valve of claim 11, wherein the conical valve needle tip (4) comprises a jacket face which includes at least two regions with different cone angles.

13. The valve of claim 12, wherein the jacket face of the valve needle tip (4) comprises three regions with different cone angles ($\delta_1$, $\delta_2$, $\delta_3$), and wherein the three regions, in the closing position of the valve, are each separated from one another by one of the two radial recesses (12, 13, 16, 17), and the cone angles ($\delta_1$, $\delta_2$, $\delta_3$) of the three regions become larger downstream (11).

14. The valve of claim 11, wherein the conical inner wall (6) of the valve body comprises at least two regions with different cone angles, and the cone angles become larger upstream (10).

15. The valve of claim 11, wherein both radial recesses are disposed in the valve needle tip (4) or in the inner wall (6) of the valve body, or wherein one radial recess (16, 17) is disposed in the valve needle tip (4) and one radial recess is disposed in the inner wall (6) of the valve body.

16. The valve of claim 11, wherein the recesses (12, 13, 16, 17) have a cross section that has the shape of a circular segment (groove), a circular sector, a triangle, quadrilateral, or other polygon, or combinations thereof.

17. The valve of claim 11, wherein the valve is a fuel injection nozzle, preferably in self-igniting internal combustion engines.

18. The valve of claim 17, characterized in that the self-igniting internal combustion engines include a common rail Diesel injection system.

19. The valve of claim 11, wherein the valve is embodied as a seat hole nozzle or as a blind bore nozzle.

20. A method for producing a valve defined in claim 11, the method comprising forming the recesses (12, 13, 16, 17) are produced by machining a standard valve.

* * * * *